US005498040A

United States Patent [19]

Silye

[11] Patent Number: 5,498,040

[45] Date of Patent: Mar. 12, 1996

[54] DECK LID LATCH AND ACTUATOR

[75] Inventor: Ronald P. Silye, Livonia, Mich.

[73] Assignee: Kelsey-Hayes Company, Romulus, Mich.

[21] Appl. No.: 282,131

[22] Filed: Jul. 28, 1994

[51] Int. Cl.[6] ..... E05C 3/04

[52] U.S. Cl. ..... 292/201; 292/43

[58] Field of Search ..... 292/201, DIG. 14, 292/DIG. 43

[56] References Cited

U.S. PATENT DOCUMENTS

| | | | |
|---|---|---|---|
| 3,113,447 | 12/1963 | Oishei | 292/201 X |
| 4,735,447 | 4/1988 | Kleefeldt | 292/201 X |
| 4,951,979 | 8/1990 | Escaravage | 292/201 X |
| 4,979,384 | 12/1990 | Malesko et al. | 292/201 X |
| 5,137,311 | 8/1992 | Brackmann:Horst . | |
| 5,150,933 | 9/1992 | Myslicki et al. | 292/DIG. 14 X |
| 5,180,198 | 1/1993 | Nakamura et al. . | |
| 5,257,840 | 11/1993 | Rouzaud | 292/201 |
| 5,295,720 | 3/1994 | Budde | 292/201 |

*Primary Examiner*—Steven N. Meyers
*Assistant Examiner*—Monica E. Millner
*Attorney, Agent, or Firm*—MacMillan, Sobanski & Todd

[57] ABSTRACT

An electrically operated latch device which includes a base, a striker moveable relative to the base, and a latch fork mounted on the base which is rotatable to capture the striker to prevent movement of the striker relative to the base. The latch fork captures the striker when the latch fork is in a first position. A pawl is rotatably mounted on the base and moveable between a position blocking rotation of the latch fork and a release position permitting rotation of the latch fork. The latch device also includes an electric actuator having a drive member. The actuator moves the drive member to an actuated position when the actuator is electrically energized, the drive member directly engaging and holding the pawl in the release position when the drive member is in the actuated position. When the drive member is in the unactuated position, the pawl is permitted to rotate to the blocking position.

17 Claims, 3 Drawing Sheets

DECK LID LATCH AND ACTUATOR

BACKGROUND OF THE INVENTION

This invention relates in general to electrically actuated latch assemblies and in particular to a latch device used for a car deck lid and the like which is provided with a power operated release.

Conventional latch devices for car deck (trunk) lids include a latch assembly mounted on a deck lid of a car and a striker fixed to the car body. The conventional latch assembly is provided with a spring-loaded latch fork having a first notch formed therein. The striker is disposed to enter a second notch formed in a stationary base of the latch assembly when the deck lid is shut. The striker engages the first notch in the latch fork, causing the latch fork to rotate in a first direction as the striker enters the second notch in the stationary portion of the latch assembly. The latch fork rotates in the first direction until it is captured by a spring-loaded pawl. With the pawl engaging the latch fork, the first and second notches are oriented with the open ends thereof non-aligned, thereby capturing the striker at the intersection of the two notches. A user can then operate an electrical switch, typically installed at the driver's seat, to cause a motor or solenoid to drive the pawl out of engagement with the latch fork, allowing the latch fork to spring return to the original position. Thus the open ends of the first and second notches are aligned, releasing the striker and opening the deck lid.

Although the conventional latch device works relatively satisfactorily, a relatively expensive and powerful solenoid or motor and a large open gear train including a worm gear has typically hitherto been utilized as a power release actuator. Worm gears have been used for their large torque multiplication, but are relatively bulky. In the past, relatively large gears have been utilized in the gear trains of latch devices because of their tolerance for relatively large registration or alignment errors which may occur during assembly of the gears in an open gear train. Therefore, such latch devices have been relatively expensive and relatively bulky, and may be difficult to manufacture and maintain.

Automotive manufacturers desire relatively compact latch devices which may be easily fitted in the available space in a variety of automobiles. Accordingly it would be desirable to provide a relatively compact deck lid latch assembly which allows remote release and opening of the deck lid and which may be easily installed and maintained.

SUMMARY OF THE INVENTION

This invention relates to an electrically operated latch device which includes a base, a striker moveable relative to the base, and a latch fork mounted on the base and rotatable to capture the striker so as to prevent movement of the striker relative to the base. The latch fork is rotatable between first and second positions, and is formed with a U-shaped notch, the notch capturing the striker when the latch fork is in the first position. A pawl is rotatably mounted on the base and moveable between a blocking position and a release position. In the blocking position the pawl engages the latch fork to prevent the latch fork from rotating from the first position. In the release position the pawl permits the latch fork to move to the second position. The pawl is prevented from rotating to the blocking position when the latch fork is in the second position. A first resilient member is provided for urging the pawl to the blocking position. The latch device also includes an electric actuator having a drive member moveable between an actuated position and an unactuated position. The actuator moves the drive member to the actuated position when the actuator is electrically energized, the drive member directly engaging and holding the pawl in the release position when the drive member is in the actuated position. The actuator includes a compact gear head unit having a number of relatively small gears contained within an enclosed housing which is directly attached to a motor housing. The latch device is also provided with a second resilient member for moving the drive member to the unactuated position when the actuator is electrically deenergized. When the drive member is in the unactuated position, it permits the pawl to rotate to the blocking position when permitted to do so by the latch fork, that is, when the latch fork is in its first position. The latch device may include an electrical switch which changes state when the pawl is moved between the release position and the blocking position.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
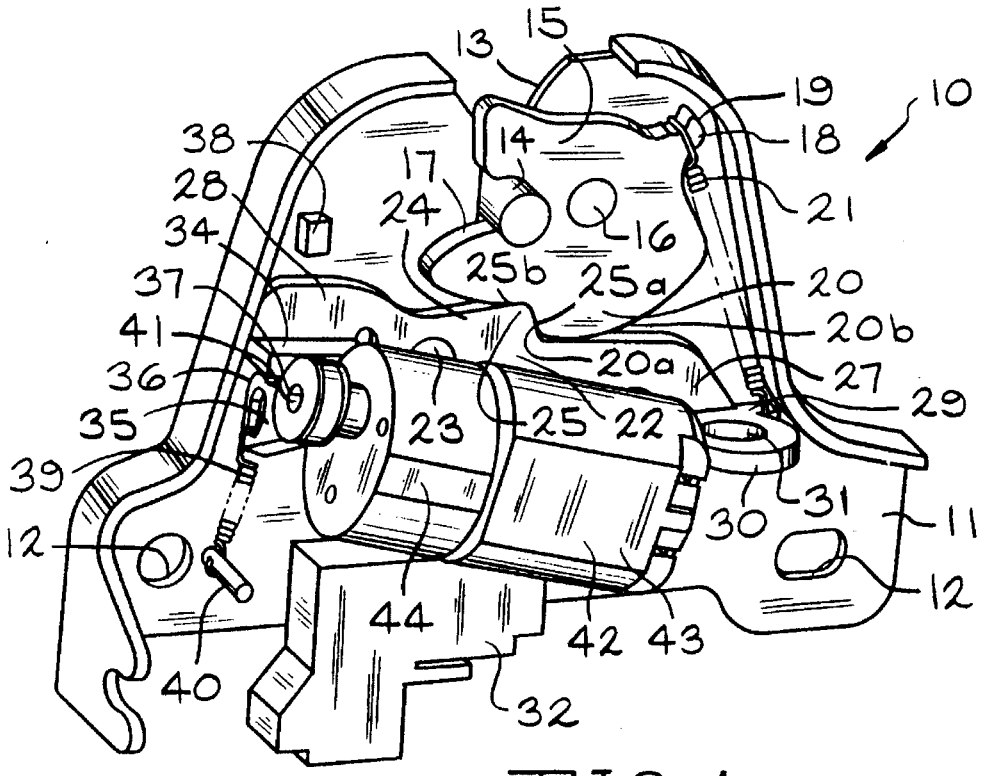
FIG. 1 is a perspective view of a latch device in accordance with the invention.

Referring now to the drawings, there is illustrated in FIG. 1 a latch device, generally indicated at 10, in accordance with this invention. The illustrated embodiment of the latch device 10 is adapted to selectively hold closed a trunk or deck lid (not shown) of a vehicle (also not shown). The latch device 10 includes a base 11. To facilitate manufacturing and servicing, the base 11 is preferably formed as a separate plate with mounting holes 12 formed therethrough. The base 11 may then be secured to the deck lid of a vehicle (not shown) by means of fasteners (not shown) extending through the mounting holes 12. The base 11 is formed with a guide groove 13. A striker 14 is secured to the body of the vehicle (not shown). The striker 14 is thus moveable relative to the base 11 and is disposed to enter the guide groove 13 of the latch device 10 as the deck lid is closed.

Figure 4:
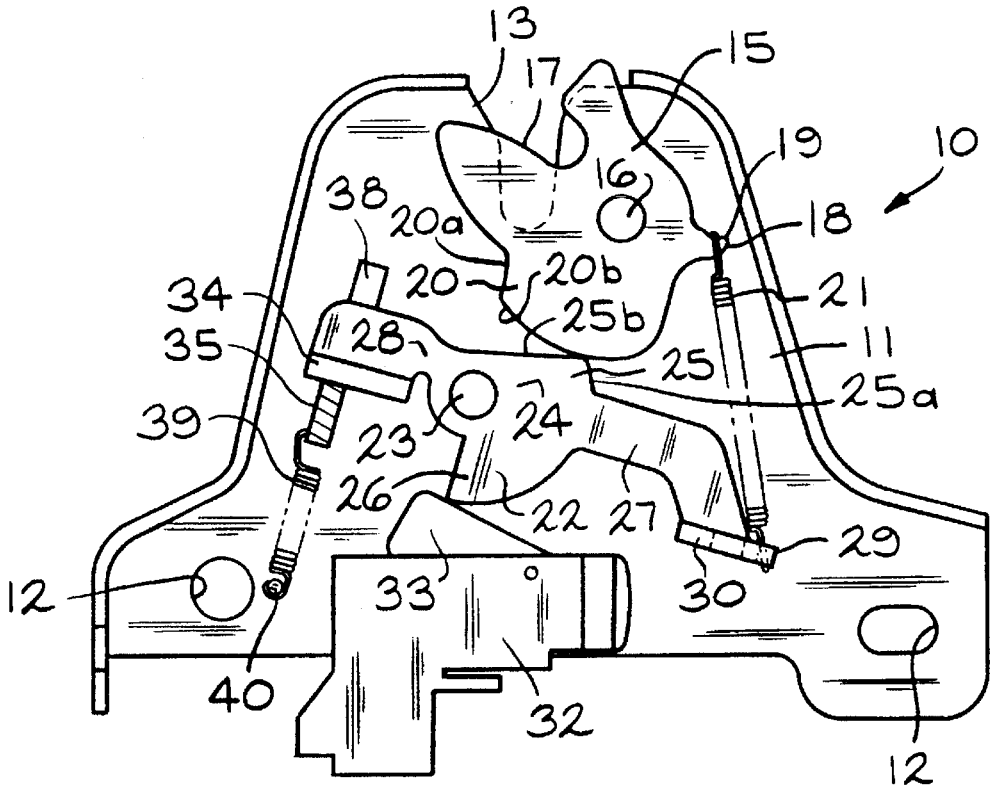
FIG. 4 is a view similar to that of FIG. 2, showing the drive member of the latch device in the actuated position thereof.
Figure 5:
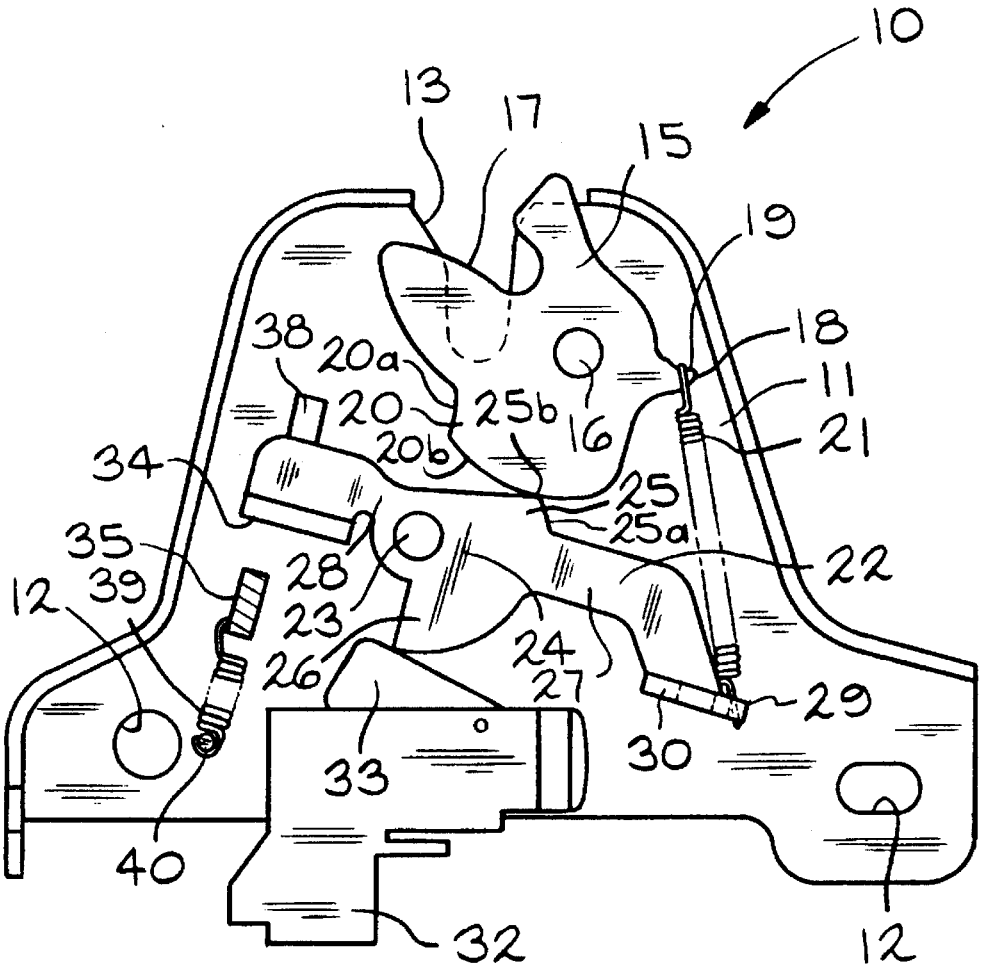
FIG. 5 is a view similar to that of FIGS. 2 and 4, showing the drive member of the latch device in the unactuated position thereof.

A latch fork 15 is rotatably journaled by a shaft 16 fixed to the base 11 in a position near the guide groove 13. The latch fork 15 is a flat plate, the periphery of which defines several features, including a generally U-shaped notch 17. The latch fork 15 further defines a generally radially extending arm 18 having a hook 19 formed on the radially outer end thereof, and a radially extending protrusion 20 defining a radially extending bearing surface **20*a* and a bearing surface 20*b*** on the radially outer edge thereof. The latch fork 15 is rotatable between a first position (FIGS. 1 and 2) and a second position (FIGS. 4 and 5). In the first position the notch 17 is generally perpendicular to the guide groove 13 of the base 11, and the latch fork 15 cooperates with the base 11 to capture the striker 14 at the point of intersection of the guide groove 13 and the notch 17. In the second position of the latch fork 15, the notch 17 is generally aligned with the guide groove 13, allowing the striker 14 to be withdrawn from the notch 17 and guide groove 13. A spring 21 engages the arm 18 to urge the latch fork 15 toward the second position thereof. The spring 21 is retained on the arm 18 as the latch fork 15 rotates by the hook 19.

A pawl 22 is rotatably journaled by a shaft 23 fixed to the base 11 in a position near the shaft 16, such that the pawl 22 is disposed to engage the latch fork 15. The shaft 23 defines an axis of rotation for the pawl 22. The pawl 22 has a body 24 in the form of a flat plate which defines a plane. The plane defined by the body 24 of the pawl 22 is perpendicular to the axis of rotation of the pawl 22 defined by the shaft 23.

The body 24 of the pawl 22 includes generally opposed first and second protrusions 25 and 26 (FIGS. 2, 4 and 5), and generally opposed first and second arms, 27 and 28. The first protrusion 25 is disposed adjacent the latch fork 15, and defines a first bearing surface 25*a* adapted to engage the bearing surface 20*a* of the latch fork 15 when the pawl 22 is in a blocking position (FIGS. 1 and 2), as will be further explained below. The first protrusion 25 of the pawl 22 also defines a second bearing surface 25*b* adapted to selectively engage the bearing surface 20*b* of the latch fork 15 (FIG. 5) to prevent the pawl 22 from rotating into the blocking position from a release position thereof.

The first arm 27 of the pawl 22 has a hook 29 formed on the radially outer end thereof. The spring 21 is secured to the arm 27 by the hook 29. The spring 21 acts to urge the pawl 22 to rotate from the release position to the blocking position thereof, while simultaneously acting to urge the latch fork 15 to rotate from the first position to the second position thereof. Thus, the design of the latch device 10 advantageously uses the single spring 21 to urge rotation of two separate components of the latch device 10. However, those of ordinary skill in the art will recognize that the pawl 22 and the latch fork 15 could each be provided with separate resilient devices for urging rotation thereof.

The first arm 27 of the pawl 22 is provided with a flange 30 extending perpendicularly to the plane defined by the body 24 of the pawl 22, away from the base 11. An aperture 31 is formed through the flange 30 to facilitate attachment of the pawl 22, via a linkage 30*a* (shown schematically by a phantom line in FIG. 2) to a key cylinder (not shown) or other manual operator for actuating the latch device 10 from outside the vehicle. Manual operation of the latch device 10 will be further described below.

Figure 2:
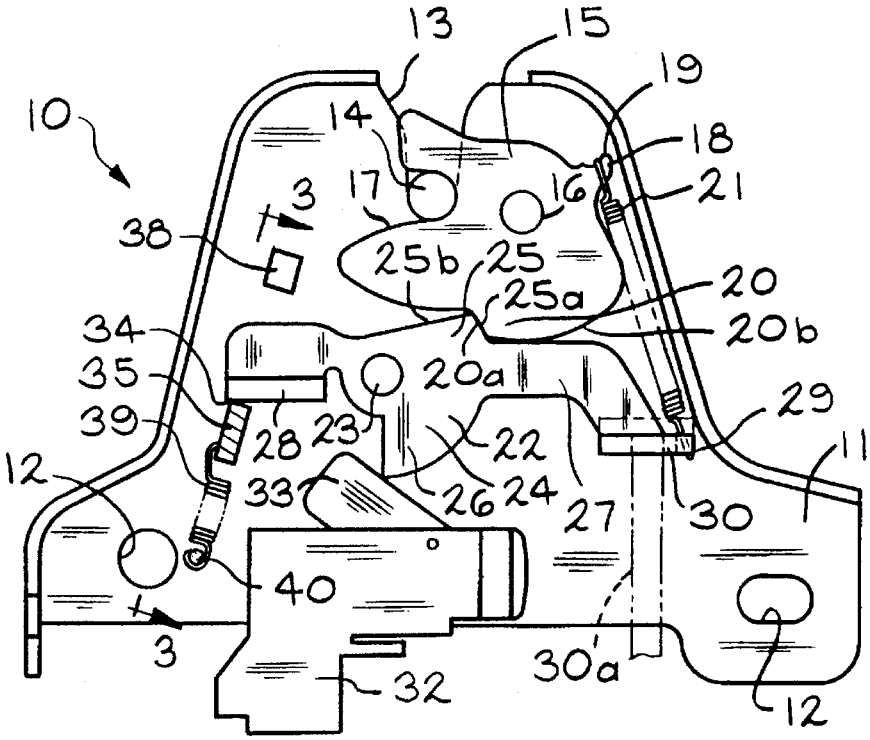
FIG. 2 is a top plan view of the latch device illustrated in FIG. 1, showing the latch device in a latched position.
Figure 3:
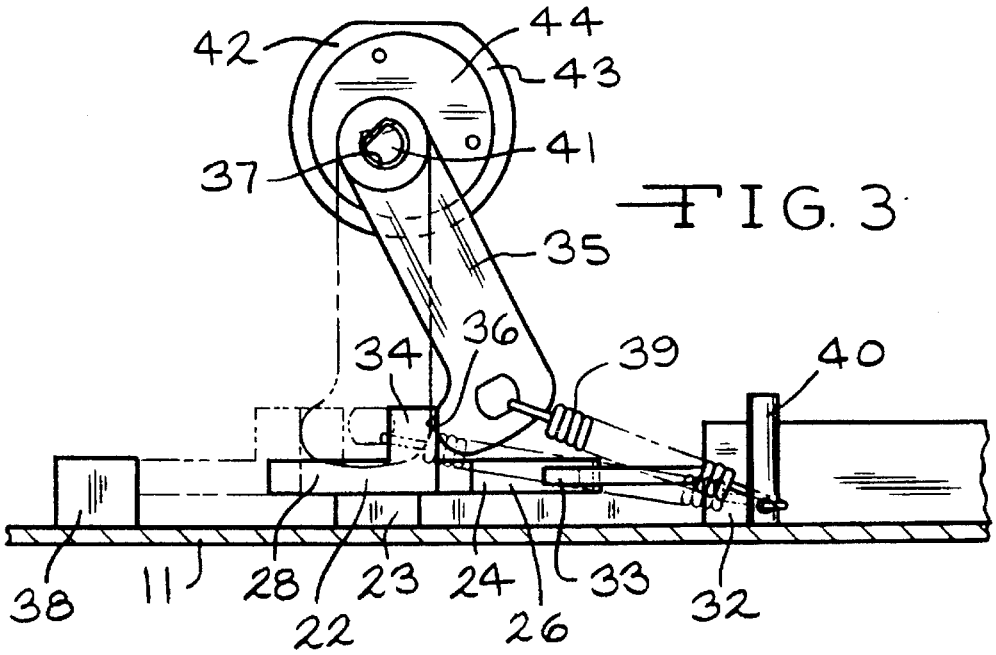
FIG. 3 is a schematic side view taken along the line 3—3 of FIG. 2, illustrating the operation of the pawl and drive member of the latch device.

As shown in FIGS. 2 through 5, the protrusion 26 of the pawl 22 is disposed adjacent to an electrical switch 32 mounted on the base 11. The protrusion 26 acts as a cam surface for actuating a moveable arm 33 of the switch 32. The switch 32 may be provided with normally open contacts, normally closed contacts, or a combination thereof (not shown). When the pawl 22 is in the blocking position thereof, the protrusion 26 is relatively far from the switch 32, and the arm 33 of the switch 33 is in its unactuated position (FIG. 2, and solid line in FIG. 3). When the pawl 22 rotates to the release position, the protrusion 26 drives the arm 33 to the actuated position thereof (FIGS. 4 and 5, and broken line in FIG. 3). As the arm 33 moves to the actuated position, the switch 32 changes state, with any closed contacts thereof opening, and any open contacts closing. Similarly, the switch 32 will change state again when the pawl 22 rotates from the release position to the blocking position. The arm 33 of the switch 32 is urged back to the unactuated position thereof by a spring (not shown) as the protrusion 26 of the pawl 22 moves away from the switch 32. The switch 32 may be connected to sensor circuitry (not shown) within the vehicle to provide an indication of the status of the latch device 10. Alternatively, for example, the switch 32 may be connected to a light (not shown) for illuminating the trunk area when the deck lid is opened.

The second arm 28 of the pawl 22 is provided with a flange 34 extending perpendicularly to the plane defined by the body 24 of the pawl 22, away from the base 11. The flange 34 is disposed to be engaged by a drive member 35.

The drive member 35 is preferably embodied as an elongate member having a rounded bearing surface 36 at one end thereof. A semi-circular mounting hole 37 is formed through the drive member 35 near the other end thereof. The drive member 35 is moveable between an unactuated position (shown in solid line in FIG. 3) and an actuated position (shown in broken line in FIG. 3). In moving from the unactuated position to the actuated position of the drive member 35, the drive member 35 directly engages the flange 34 of the second arm 28 of the pawl 22, rotating the pawl 22 to the release position thereof. As will be further explained below, a stop block 38, mounted on the base 11, prevents the drive member 35 from rotating the pawl 22 significantly beyond the position in which the pawl 22 is disengaged from the latch fork 15.

A tension spring 39 is fixed at one end to the drive member 35 and at the other end thereof to a feature 40. The feature 40 is fixed relative to the base 11. The feature 40 may be embodied as a pin fixed to the base 11. The spring 39 urges the drive member 35 to move from the actuated position thereof to the unactuated position thereof.

As best shown in FIGS. 1 and 3, the semi-circular output shaft 41 of an electric actuator 42 extends through the semi-circular mounting hole 37 of the drive member 35 with an interference fit, thereby fixing the drive member 35 on the shaft 41 for rotation therewith. The external housing of the actuator 42 is fixed relative to the base 11. Preferably, the latch device 10 is provided with a rigid cover (not shown) upon which the actuator 42 is mounted. The rigid cover is fixed to the base 11, and, in addition to supporting the actuator 42, provides protection for the moving parts mounted on the base 11. The actuator 42 is preferably mounted with the body 24 of the pawl 22 disposed between the actuator 42 and the base 11. This provides a relatively compact design which is important in modern vehicle designs. However, those of ordinary skill in the art will recognize that the actuator 42 may be mounted in various other arrangements, such as on a flange (not shown) formed integrally with perimeter of the base 11, adjacent to the arm 28 of the pawl 22.

The actuator 42 includes an electric motor 43 and a gear head 44. The gear head 44 contains a set of relatively small reduction gears (not shown) contained and mounted within a single housing 44*a*. The housing 44*a* is directly attached to the motor 43. Thus the gears may be relatively smaller than those used in the past, because, although smaller gears can only accept smaller registration errors, this arrangement helps minimize registration errors between the gears and between the gears and the motor 43. Thus the overall size of the actuator 42 may be reduced, and thus the overall size of the latch device 10 may be reduced. The gears drive the output shaft 41. A suitable motor and gear head combination may be obtained from Johnson Electric North American, Inc. of Fairfield, Conn.

The operation of the latch device 10 will now be described. In the following description of the operation of the latch device 10, the directions clockwise, counterclockwise, left, and right, and words of similar import, refer to the directions relative to the views of the associated illustrations, and not necessarily to the actual latch device when installed. Accordingly, no limitation is intended or should be inferred from the directional notation of this description.

The latch device 10 is in the condition illustrated in FIG. 5 when the trunk of the vehicle is open. To close and latch the deck lid of the trunk, the deck lid is manually closed, causing the striker 14 secured to the deck lid to enter into the guide groove 13 in the base 11. As the deck lid is further closed, the striker 14 moves relative to the base 11 to a point where the striker 14 engages the notch 17 formed in the latch fork 15. The striker 14 continues to move into the guide groove 13, causing the latch fork 15 to rotate in a counterclockwise direction from the second position thereof, illustrated in FIG. 5, to the first position thereof, illustrated in FIGS. 1 and 2.

When the latch fork 15 is in the first position thereof, the spring 21 can rotate the pawl 22 into the blocking position of the pawl 22. In the blocking position, as described above, the bearing surface 25*a* of the pawl 22 bears against the bearing surface 20*a* of the latch fork 15. Thus the latch fork 15 is prevented from rotating from the first position toward the second position, and the striker 14 remains captured by the latch fork 15.

Movement of the pawl 22 to the blocking position causes the second protrusion 26 of the pawl 22 to move relatively away from the switch 32, thereby permitting the arm 33 of the switch 32 to move outwardly under spring pressure to the position illustrated in FIG. 2. As the arm 33 is repositioned, the switch 32 changes state, generating a signal indicative of the pawl being in the blocking position.

In order to unlatch the latch device 10, the pawl 22 must be rotated to the release position. This may be accomplished manually or electrically. To rotate the pawl 22 manually, typically a key will be used to operate a key cylinder (not shown) mounted on the vehicle body adjacent to the latch device 10. The key cylinder is linked to the pawl 22 by a rod (not shown) engaging the aperture 31 in the flange 30 of the pawl 22. As the key cylinder is operated, the arm 27 of the pawl 22 is pulled by the rod, rotating the pawl 22 to the release position.

Alternatively, the pawl 22 can be rotated electrically. This is accomplished by electrically energizing the motor 43 of the actuator 42. When energized, the motor 43 drives the gear head 44 to rotate the output shaft 41 of the gear head 44, and the drive member 35 fixed thereto, into the actuated position thereof, illustrated by the broken line in FIG. 3, and stretching the spring 39. The drive member 35 drives against the flange 34 on the arm 28, moving the arm 28 into engagement with the stop block 38, and rotating the pawl 22 to the release position thereof.

However the pawl 22 is rotated from the blocking position to the release position, as the pawl 22 rotates, the second protrusion 26 repositions the arm 33 of the switch 32. This causes the switch 32 to change state. This in turn provides indication of the position of the pawl 22.

Referring now to FIG. 4, with the pawl 22 rotated to the release position thereof, the bearing surface 25*a* of the pawl 22 is disengaged from the bearing surface 20*a* of the latch fork 15. Thus the latch fork 15 is free to rotate from the first position thereof (illustrated in FIGS. 1 and 2) to the second position thereof (illustrated in FIGS. 4 and 5) under the urging of the spring 21. Thus the notch 17 in the latch fork 15 is generally aligned with the guide groove 13 in the base 11, the latch device 10 is unlatched, the striker 14 is released, and the deck lid may be opened.

When the latch fork 15 has rotated to the second position thereof, the motor 43 of the actuator 42 can be deenergized. Although not shown, a timing circuit may be provided to keep the motor 43 energized for a sufficient amount of time from the moment the motor 43 is energized to allow the latch fork 15 to rotate to the second position thereof. Those of ordinary skill in the art will recognize that other control schemes may be used, including having the user keep a momentary contact control button depressed for the brief period required. When the motor 43 is deenergized, the spring 39 will urge the drive member 35 to move to the unactuated position thereof, back-driving the gear head 44 and motor 43 of the actuator 42, as illustrated in FIG. 5. With the drive member 35 no longer bearing against the flange 34 of the arm 28, the spring 21 will tend to urge the pawl 22 to rotate to the blocking position thereof. However, this rotation will be prevented by the bearing surface 25*b* of the pawl 22 engaging the bearing surface 20*b* of the protrusion 20 on the latch fork 15. As discussed above, the pawl 22 will be free to rotate to the blocking position thereof only when the latch fork 15 is rotated to the first position thereof.

Those of ordinary skill in the art will recognize that while the springs 21 and 39 are illustrated as tension coil springs, various other types of resilient members may be substituted therefore, such as a leaf spring or a compression member formed of a resilient elastomeric material.

It will also be recognized that other components of the latch device 10, such as the drive member 35, may be configured differently than described. The drive member 35 may, for example, be configured as a generally circular cam with a radially or axially extending lobe which directly bears against the flange 34 during part of a 360° rotation of the cam to rotate the pawl 22. The actuator 42 may be oriented parallel to the line of action of the drive member 35 or at an angle thereto. Indeed, among other additional alternatives, the actuator 42 may be a solenoid coil and the drive member 35 may be the armature thereof which reciprocates to selectively bear directly against the flange 34.

In accordance with the provisions of the patent statutes, the principle and mode of operation of the present invention have been explained and illustrated in the preferred embodiment, however, it will be understood that the present invention may be practiced otherwise than as specifically explained and illustrated without departing from its spirit or scope.

What is claimed is:

1. An electrically operated latch device comprising:

a base;

a striker moveable relative to said base;

a latch fork rotatably mounted on said base and having a notch formed therein, said latch fork being rotatable between first and second positions, said latch fork capturing said striker in said notch when said latch fork is in said first position;

a pawl rotatably mounted on said base and moveable between a blocking position in which said pawl engages said latch fork to prevent said latch fork from rotating from said first position, said pawl being moveable to a release position to permit said latch fork to move to said second position, said pawl being prevented from rotating to said blocking position when said latch fork is in said second position;

an electrical switch engaging said pawl, said switch being adapted to change state when said pawl is moved between said release position and said blocking position;

a first spring urging said pawl to said blocking position; and an electric actuator having a drive member moveable between an actuated position and an unactuated position, said drive member directly engaging and urging said pawl to said release position when said drive member is moved to said actuated position.

2. The latch device of claim 1 wherein said first spring is a tension spring having a first and a second end, said first end of said tension spring engaging said latch fork and said second end of said tension spring engaging said pawl to urge said latch fork to rotate to said second position, said notch in said latch fork releasing said striker in said second position.

3. The latch device of claim 1 wherein said pawl includes a first arm formed thereon operationally coupled to a manual release linkage.

4. The latch device of claim 1 wherein said pawl is rotatable about an axis of rotation, said pawl defining a plane perpendicular to said axis of rotation, said pawl including a flange extending out of said plane, and wherein said electric actuator includes a selectively rotatable shaft disposed outside of said plane, and wherein said drive member of said actuator is an elongate member fixed to said shaft of said actuator, said drive member being rotated by said shaft to directly engage said flange of said pawl.

5. The latch device of claim 1 further including a tension spring for moving said drive member to said unactuated position when said actuator is electrically deenergized, said drive member being disposed in said unactuated position to permit said pawl to rotate to said blocking position when said latch fork is in said first position.

6. An electrically operated latch device comprising:

a base having a feature fixed thereto;

a striker moveable relative to said base;

a latch fork rotatably mounted on said base and having a notch formed therein, said latch fork being rotatable between first and second positions, said latch fork capturing said striker in said notch when said latch fork is in said first position;

a pawl rotatably mounted on said base and rotatable about an axis of rotation between a blocking position in which said pawl engages said latch fork to prevent said latch fork from rotating from said first position, said pawl being moveable to a release position to permit said latch fork to move to said second position, said pawl being prevented from rotating to said blocking position when said latch fork is in said second position, said pawl including a body having a protrusion therefrom and defining a plane perpendicular to said axis of rotation, a first arm operationally coupled to a manual release mechanism, and a second arm having a flange which extends out of said plane;

a first spring coupled to said pawl and said latch fork for urging said pawl to said blocking position and urging said latch fork to said second position;

an electrical switch engaging said protrusion, said switch being adapted to change state when said pawl is moved between said release position and said blocking position; and an actuator disposed substantially outside of said plane, said actuator including an electric motor having an external housing which is fixed relative to said base, a gear head reduction gear unit having a separate housing mounted on said motor and also having an output shaft, a drive member mounted on said output shaft, and a second spring coupled between said drive member and said feature fixed to said base, said actuator adapted to move said drive member between an actuated position when said motor is electrically energized, said drive member directly engaging and holding said pawl in said release position when said drive member is in said actuated position, said second spring urging said drive member to an unactuated position, in which said drive member is disengaged from said pawl, when said motor is electrically deenergized.

7. A latch device having a power release, comprising:

a first portion;

a second portion moveable relative to said first portion;

a latch mounted on said second portion for engaging said first portion and fixing said second portion relative to said first portion; and a power release fixed relative to said second portion and including an electric motor having a housing, a gear head reduction gear unit having a separate housing fixed to said motor housing and also having an output shaft operatively connected to said latch to selectively cause said latch to disengage said first portion whereby said second portion can move relative to said first portion.

8. An electrically operated latch device comprising:

a base;

a striker moveable relative to said base;

a latch fork rotatably mounted on said base and having a notch formed therein, said latch fork being rotatable between first and second positions, said latch fork capturing said striker in said notch when said latch fork is in said first position;

a pawl rotatably mounted on said base and moveable between a blocking position in which said pawl engages said latch fork to prevent said latch fork from rotating from said first position, said pawl being moveable to a release position to permit said latch fork to move to said second position, said pawl being prevented from rotating to said blocking position when said latch fork is in said second position;

a spring urging said pawl to said blocking position; and an electric actuator including an electric motor having an external housing, said external housing being fixed relative to said base, said actuator also including a gear head reduction unit having a separate housing mounted to said motor external housing, said gear head reduction gear unit also having an output shaft having a drive member fixed thereto, said drive member being movable between an actuated position and an unactuated position, said drive member directly engaging and urging said pawl to said release position when said drive member is moved to said actuated position, said drive member permitting from said pawl to move to said blocking position when said drive member is—was in said unactuated position.

9. The latch device of claim 8 further including an electrical switch engaging said pawl, said switch being adapted to change state when said pawl is moved between said release position and said blocking position.

10. The latch device of claim 8 wherein said spring additionally urges said latch fork to rotate to said second position, said notch in said latch fork releasing said striker in said second position.

11. The latch device of claim 10 wherein said spring is a tension spring having a first and a second end, said first end of said tension spring engaging said latch fork, said second end of said tension spring engaging said pawl.

12. The latch device of claim 8 wherein said pawl includes a first arm formed thereon operationally coupled to a manual release linkage.

13. The latch device of claim 8 wherein said pawl is rotatable about an axis of rotation, said pawl defining a plane perpendicular to said axis of rotation, said pawl including a flange extending out of said plane, and wherein said electric actuator is disposed outside of said plane, said drive member of said actuator disposed to selectively directly engage said flange of said pawl.

14. The latch device of claim 13 wherein said pawl defines a cam surface in said plane which engages an electrical switch mounted on said base adjacent to said pawl, said switch changing state when said pawl is moved between said release position and said blocking position.

15. The latch device of claim 8 further including a second spring for moving said drive member to said unactuated position when said actuator is electrically deenergized, said drive member permitting said pawl to rotate to said blocking position when said drive member is in said unactuated position and said latch fork is in said first position.

16. The latch device of claim 8 wherein said pawl rotates in a first plane and said drive member rotates in a second plane.

17. The latch device of claim 8 wherein said actuator further includes a second spring coupled between said drive member and said base urging said drive member to an unactuated position, in which said drive member is disengaged from said pawl.

* * * * *